United States Patent [19]

Vroom et al.

[11] Patent Number: 5,001,461

[45] Date of Patent: Mar. 19, 1991

[54] SKI EQUIPMENT THEFT ALARM

[76] Inventors: Roy Vroom, 1355 Mountain Dr., Aspen, Colo. 81611; Jeffrey P. Vroom, Box 885, Basalt, Colo. 81621

[21] Appl. No.: 333,568

[22] Filed: Aug. 18, 1989

[51] Int. Cl.[5] ..... G08B 13/14

[52] U.S. Cl. ..... 340/572; 340/571; 340/573

[58] Field of Search ..... 340/571, 572, 566, 573, 340/539

[56] References Cited

U.S. PATENT DOCUMENTS 3,988,724 10/1976 Anderson ..... 340/572

4,835,523 5/1989 Pruett ..... 340/571

4,843,371 6/1989 Kuei et al. ..... 340/571

*Primary Examiner*—Reinhard J. Eisenzopf

*Assistant Examiner*—Geoff Sutcliffe

[57] ABSTRACT

A system for protecting skis from theft which includes a digital transmitter, a timer, and a motion sensor all attached to the ski binding itself, and a hand held digital receiver. The system is fully enabled when the user removes the ski boot from the binding and manually turns on the receiver. Subsequent movement of the skis, for a length of time predetermined by the timer, allows the transmitter to send a unique digital code by standard radio frequency. The digital code is detected by only one receiver which in turn produces an audible alarm to alert the person carrying the receiver.

8 Claims, 1 Drawing Sheet

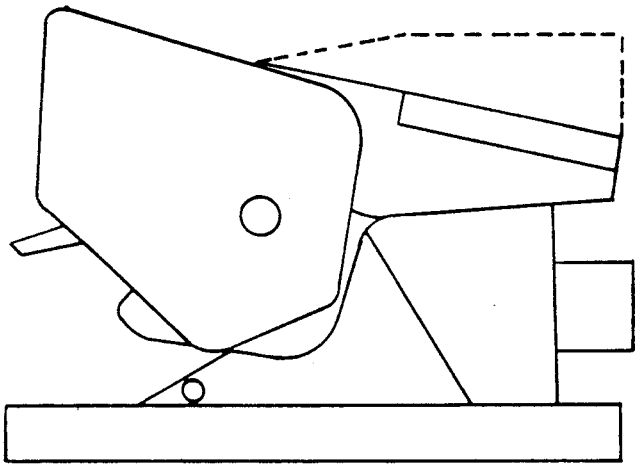
FIG. 1
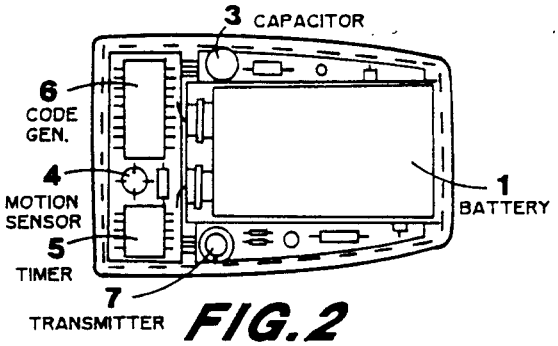
FIG. 2
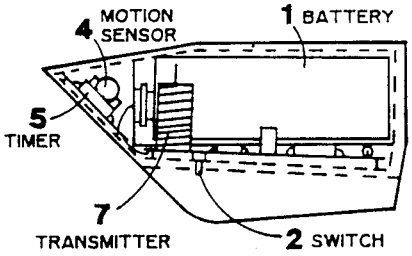
FIG. 3
FIG. 4
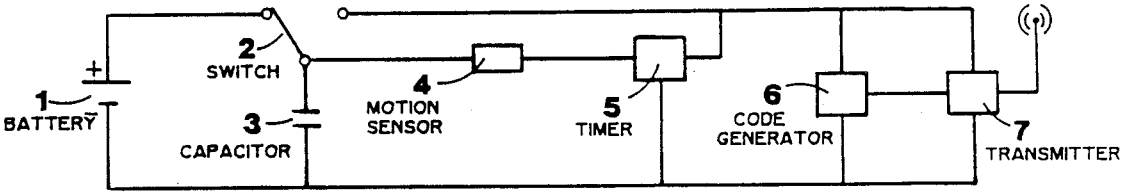
FIG. 5
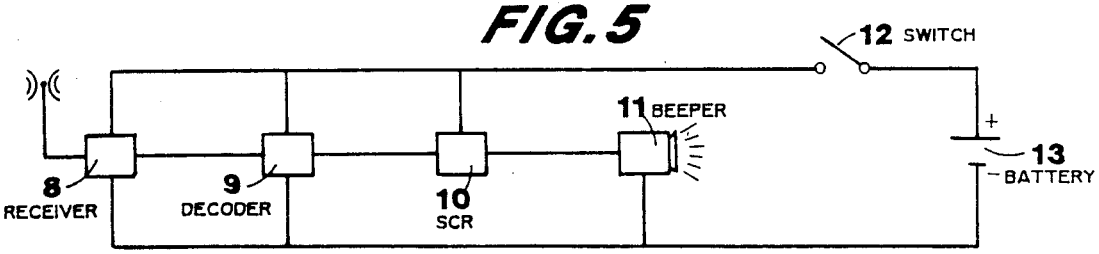

SKI EQUIPMENT THEFT ALARM

BACKGROUND OF THE INVENTION

In recent years the skiing industry has experienced grave increases in the numbers of skis being stolen from open storage racks on ski mountains. Accordingly, the need for establishing effective means to deter these thefts is of paramount importance. This invention provides such deterrent means through an electronic transmitter-receiver alarm system in which the protective device including the transmitter is attached to the ski binding, and the alerting device including the receiver is carried by the rightful owner of the skiing equipment or by a duly authorized person.

There have been numerous systems previously developed which address the general issue of theft protection, some of which have specified the protection of skis through radio transmitter-receiver means. However, none of those systems incorporate a device which includes transmitter attachment to or containment within the actual ski binding, enabling and disabling of the alarm system by removing a ski boot from the ski binding and inserting a ski boot into the ski binding respectively, and selective electronic timing means to insure against false alarms.

SUMMARY OF THE INVENTION

The primary intent of this invention is to provide a means for detecting the unauthorized tampering with, or theft of skiing equipment that has been left in an unsecured and unguarded location that is out of sight of the owner. This circumstance occurs most frequently when a skier leaves the skis unattended outside a ski mountain restaurant and goes inside where the skis are no longer visible. Specifically, this invention allows for a motion detector and transmitter to be enabled when the skier steps out of the ski binding, then, once the skis are placed in a motionless position, if the skis are in any way moved, the transmitter will be activated and the receiver will warn the skier immediately.

An object of this invention is to provide a theft protection device which has a transmitter that is sufficiently compact so as not to inhibit normal ski binding operation, and which has a receiver that is sufficiently compact so as not to inhibit the skier.

Another object of this invention is that the normal enabling and disabling of the protective device be convenient to the user, this being achieved through the normal removal of the ski boot from the binding and the normal placement of the ski boot into the binding respectively.

Yet another object of this invention is to provide for a timer means by which the protective device can differentiate between incidental contact to the skis and a legitimate threat of theft to the skis, and a similar timer means by which the duration of transmission of the actual alarm signal can be limited to conserve battery life.

A further object of this invention is to provide a secondary capacitive temporary power source for the protective device which unconditionally turns on the transmitter for a brief period when a ski boot is placed into the binding, thereby accounting for the unlikely failure of the motion detector or timer means and informing the owner that an unauthorized person is attempting to step into the bindings.

A still further object of this invention is that the entire apparatus be able to function in severely cold and/or wet weather conditions.

These and other objects of the invention will become apparent from the drawings in conjunction with the detailed description.

BRIEF DESCRIPTION OF THE DRAWINGS

FIG. 1, a profile view of a heel piece of a specific brand of binding, diagrams the possible additional component encasement that would be required to replace the original plastic piece on this binding;

FIG. 2 is a cutaway plan view of only the additional component encasement of FIG. 1 and shows a possible arrangement of circuit components;

FIG. 3 is a cutaway profile view of only the additional component encasement of FIG. 1 and shows the profile of the possible arrangement of FIG. 2;

FIG. 4 is a block diagram of the protective device, or the signal generator/transmitter as it is called in the detailed description;

FIG. 5 is a block diagram of the alerting device, or the signal receiver/alarm beeper as it is called in the detailed description.

DETAILED DESCRIPTION OF THE INVENTION

The device is an electronic anti-theft alarm for ski equipment, designed to mount to the ski binding. The binding shown in FIG. 1 of the drawings is a specific brand used for the purposes of sketching—it is intended that the alarm can be fitted to any brand of binding, with minor modifications to its encasement and lay-out.

There are two major parts to the alarm system; the signal generator/transmitter (part numbers 1 thru 7 of FIG. 2 thru FIG. 4) contained in the ski binding itself, and the signal receiver/alarm beeper (part numbers 8 thru 13 of FIG. 5) which is carried by the skier at all times while away from his skis on the ski mountain.

The signal generator/transmitter, as shown in FIG. 2 thru FIG. 4, has a simple DC battery power source 1, with the choice of being either rechargeable or non-rechargeable, and a two pole mechanical switch 2 which operates when one steps into or out of the binding. When one steps out of the binding, the switch 2 will occupy the position shown in FIG. 4, thus turning on the power and enabling the alarm and charging the secondary source capacitor 3. Once the skis are in any stationary position, the signal receiver/alarm beeper would then be turned on manually. At this point, when the motion sensor switch 4 is tripped by someone moving the skis, the power is sent to the timer circuitry 5, which then measures the duration of the motion, and if this duration is measured to be less than a prespecified amount of time, the timer circuitry 5 interprets the motion to be incidental and ignores the initial signal from the motion sensor switch 4 and resets the system to detect further motion; if the duration of the motion is measured to be greater than this prespecified amount of time, the timer circuitry 5 in turn sends the power to the digital code generator 6, and the FM trasmitter 7. When they receive power, the code generator 6 sends a unique digital code to the transmitter 7, which then transmits this digital code by a conventional FM carrier to the signal receiver/alarm beeper. The duration of this transmission is determined by the same timer circuitry 5, which will shut off the alarm after a prespecified amount of time and reset it to be ready to detect further motion. It is conceivable, although unlikely, that the motion sensor switch 4 or timer circuitry 5 could fail; in this case, if someone should take the skis and step into the binding, the two pole mechanical switch 2 will change position to its other pole. Note that this action disconnects the battery source 1 and causes the secondary source capacitor 3 to be connected to the alarm circuitry directly, bypassing both the motion sensor switch 4 and the timer circuitry 5; thusly, the signal generator/transmitter will operate until the secondary source capacitor 3 is fully discharged. This action also provides the owner of the skis with a method to turn the power off and disable the signal generator/transmitter, while making it impossible for just anybody to do so without sending the alarm signal.

The signal receiver/alarm beeper, as shown in FIG. 5, contains a conventional FM receiver 8 which detects a specific carrier frequency common to all these transmitter/receiver alarm devices. The FM receiver 8 then demodulates the incoming signal and sends the unmodulated digital code, which is unique for each of the transmitter/receiver alarm devices, to the digital decoder 9. The digital decoder 9 then checks to see if the transmitted digital code is the one code that is supposed to set off the beeper (in other words, if there are several of these alarm devices in the same vicinity, it is desired that only my beeper be activated by my alarm transmitter and not by anyone else's). If the code is correct, the digital decoder 9 then sends a signal to turn on the SCR (silicon controlled rectifier 10), which sends power to the beeper 11, thusly sounding an audible tone alerting the ski owner carrying the receiver that someone is tampering with the skis. The tone will continue sounding until the owner manually switches off the receiver/-beeper with the on/off switch 12 provided. The receiver/beeper will be powered with a battery 13 in much the same fashion as the signal generator/transmitter in the binding, and it will be sized such that it can be carried comfortably around the skier's neck or in a pocket.

The above description is only the preferred embodiment of the invention and the above drawings only show one of many possible circuit configurations, component layouts and encasements. Many different applications and modifications may be made to this device which are still encompassed by the spirit of the invention.

It is understood that the above mentioned description is not limiting to the spirit of the invention, and that the scope of the invention is set forth within the following claims.

What is claimed is:

1. A system for protecting skis from theft comprised of (a) means for switching said system between two states, an enabled state and a disabled state, said switching means is switched to said enabled state when a ski boot is removed from the ski binding of a ski, and is switched to said disabled state when said boot is latched into said binding of said ski;

(b) a motion sensing means;

(c) a radio transmitter;

(d) a first housing which encloses said switching means, said motion sensing means, said radio transmitter, said first housing attached to said ski binding;

(e) a second housing which encloses a radio receiver and an alarm generator;

(f) and means for causing said radio transmitter to emit a signal when motion is sensed by said motion sensing means and said system is in an enabled state, said radio receiver detecting said signal and activating said alarm generator.

2. The system of claim 1, wherein said signal is a digitally coded signal.

3. The system of claim 1, wherein said first housing also encloses a timer means, said timer means disables said radio transmitter a predetermined period of time after a sensing of motion by said motion sensing means.

4. The system of claim 2, wherein said radio receiver is connected to a decoder, said decoder enables said alarm generator only when a properly coded signal has been received by said radio receiver.

5. The system of claim 1, wherein said radio transmitter emits said signal for a predetermined period of time when said system is initially switched from said enabled state to said disabled state.

6. The system of claim 1, wherein said second housing is hand held, portable and also encloses an on/off switch, whereby said radio receiver may be manually turned on or off.

7. The system of claim 1, wherein said alarm generator emits an audible alarm.

8. The system of claim 1, wherein said first housing further encloses a timer means, said timer means delays the emitting of said signal by said radio transmitter for a predetermined period of time after a sensing of motion by said motion sensing means.

* * * * *